US006699022B2

(12) United States Patent
Izawa

(10) Patent No.: US 6,699,022 B2
(45) Date of Patent: Mar. 2, 2004

(54) VACUUM EXHAUST APPARATUSES AND VACUUM EXHAUST METHODS

(75) Inventor: Hiroshi Izawa, Kyoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/013,444

(22) Filed: Dec. 13, 2001

(65) Prior Publication Data

US 2002/0090310 A1 Jul. 11, 2002

(30) Foreign Application Priority Data

Dec. 21, 2000 (JP) ..... 2000-388868

(51) Int. Cl.[7] ..... F01C 1/30

(52) U.S. Cl. ..... 418/5; 418/89; 418/100; 236/37; 236/67

(58) Field of Search ..... 418/88, 89, 5, 418/100; 236/37, 67

(56) References Cited

U.S. PATENT DOCUMENTS 3,066,855 A * 12/1962 Lorenz ..... 418/5
3,994,642 A * 11/1976 Johannes ..... 418/100
5,304,405 A * 4/1994 Kobayashi et al. ..... 427/534
5,667,367 A * 9/1997 Kubo et al. ..... 418/100

FOREIGN PATENT DOCUMENTS

| | | | | |
|---|---|---|---|---|
| JP | 60219493 A | * | 11/1985 | ..... F04C/29/02 |
| JP | 62291488 A | * | 12/1987 | ..... F04C/25/02 |
| JP | 2-21914 | | 1/1990 | |
| JP | 02129371 A | * | 5/1990 | ..... C23C/16/44 |
| JP | 02129372 A | * | 5/1990 | ..... C23C/16/44 |
| JP | 06074174 A | * | 3/1994 | ..... F04C/23/00 |
| JP | 6-159279 | | 6/1994 | |
| JP | 9-195965 | | 7/1997 | |

* cited by examiner

*Primary Examiner*—Thomas Denion
*Assistant Examiner*—Theresa Trieu
(74) *Attorney, Agent, or Firm*—Fitzpatrick, Cella, Harper & Scinto

(57) ABSTRACT

A vacuum exhaust apparatus includes an oil-sealed rotary pump with a gas inlet for taking a gas into the pump. The gas inlet has a gas inlet flange to join with a flange of a gas inlet pipe for guiding the gas to the pump. An oil supply section connects with the gas inlet pipe and supplies an oil into the gas inlet pipe.

15 Claims, 3 Drawing Sheets

VACUUM EXHAUST APPARATUSES AND VACUUM EXHAUST METHODS

BACKGROUND OF THE INVENTION

1. Field of the Invention

The present invention relates to vacuum exhaust (or evacuation) apparatuses, and vacuum exhaust methods using the vacuum exhaust apparatuses. More particularly, the invention relates to vacuum exhaust apparatuses and vacuum exhaust methods suitably applicable to construction of a vacuum equipment used for deposited film formation, etching, etc. and to mass production of repeating deposited film formation or etching over long periods of time using volumes of gas.

2. Related Background Art

A variety of methods have been proposed heretofore as methods of forming functional deposited films for making solar cells, light-receiving (or photoreceptive) members for electrophotography, and so on. In general, these methods require a vacuum pump capable of evacuating a chamber, a pipe, etc. to a high vacuum, because a reaction has to take place in a high vacuum, and because mixing of impurities can heavily degrade film characteristics, and so on. As such vacuum pumps, oil-sealed rotary pumps are commonly and widely used for reasons of low price, ease to handle, capability of evacuation from the atmospheric pressure, and so on.

Inside the oil-sealed rotary pumps, a small amount of oil circulates in a cylinder. While lubrication and sealing is maintained by the oil, a rotor is rotated in the cylinder to positive displacement exhaustion.

If the oil-sealed rotary pump is used in an environment with a corrosive gas, e.g., on the occasion of carrying out cleaning to remove films and byproducts that are deposited inside a chamber by etching after deposited film formation therein, these gas and powdery products can degrade the lubricity of oil, change the viscosity, make sludge, cause breakage of oil film in the cylinder, decrease an oil circulation amount, and so on. As a result, they will increase frequencies of occurrence of degradation of evacuation performance, seizure, etc. and largely degrade durability of the oil-sealed rotary pump.

Various countermeasures were taken against these problems; e.g., oil filtration to remove dust particles such as the powdery products, sludge, etc. (hereinafter referred to as contaminants) from the oil, use of an oil feed type pump for supply of new oil to an oil tank and discharge of used oil at every rotation of the pump, execution of frequent oil exchanges, use of corrosion-resistant, special mineral oil, employment of a method of introducing an inert gas into the pump case to dilute the corrosive gas, covering each part of the pump with a corrosion-resistant coating, and so on. The countermeasures on the apparatus side include, for example, a method of attaching a cold trap or a dust filter to a pump-inlet-side path in order to remove the contaminants of the corrosive gas, powdery products, and so on. Further, the oil-sealed rotary pump is replaced by another pump such as a dry pump or the like in certain cases.

With the techniques as described above, it was, however, hard to repeatedly operate the vacuum pump continuously over long periods of time using volumes of gas. There can arise a problem, for example, in mass production of solar cells for electric power made of amorphous silicon.

In the continuous and repetitive production over long periods of time using volumes of gas, powdery products made during the production result in making a large amount of sludge. With use of a corrosive gas, corrosiveness thereof may pose a significant problem. Unless this large amount of sludge or corrosive gas is effectively removed, clogging, corrosion, or the like will decrease the oil circulation amount in the oil-sealed rotary pump and deteriorate the oil, so as to cause breakage of oil film and failure in lubrication in the cylinder, which will result in causing degradation of evacuation performance, or failure such as seizure or the like. Since the oil is exposed to a large amount of an active, corrosive gas, particularly, at a junction between the cylinder and the inlet port, the oil is heavily deteriorated there to degrade the oil properties such as lubricity and others considerably. Further, since the cylinder is in contact with vanes at mechanical angles inside the cylinder, the oil film breakage can occur readily, depending upon change in the oil properties and amount. As described above, the prior art of circulating a small amount of oil in the cylinder inevitably suffers the oil film breakage and insufficient lubrication, which was the principal cause of the mechanical failure of the oil-sealed rotary pump.

In order to construct a production apparatus suitable for low cost processes of mass production and the like, the oil-sealed rotary pump is required to be inexpensive and low in instrument cost, present high reliability with less failure, have a simple structure, and allow easy maintenance.

The normal oil filtration mechanisms fail to remove the large amount of sludge produced, which will pose problems of decrease in the oil circulation amount inside the rotary pump because of clogging or the like, occurrence of the oil film breakage and insufficient lubrication in the cylinder, degradation of evacuation performance, seizure, and so on. Particularly, where a large amount of a corrosive gas is used in etching or the like to result in making a large amount of sludge, a large-capacity mechanism capable of removing the large amount of sludge has to be used in order to operate the pump stably. Likewise, where the cold trap or the dust filter is installed, it has to be one with a large capacity. Since these configurations are inserted into an exhaust system and lower the exhaust conductance, the vacuum pump itself has to have a large capacity in order to suppress it. When the conventional oil filtration, cold trap, dust filter, or the like is added, the instrument cost becomes high because of the increase of capacity. It also requires time and cost for maintenance in order to prevent failure of those added components. This poses problems of degrading maintainability and increasing running cost.

On the other hand, since the dry pumps, oil feed type pumps, etc. are generally expensive, use of these pumps raises problems of increasing the instrument cost and, in turn, increasing the production cost.

As for the methods of providing the corrosion-resistant coating over each part of the pump and diluting the corrosive gas with an inert gas, the effect is not sufficient where the large amount of sludge is made or where the large amount of a corrosive gas is repeatedly used over long periods of time.

SUMMARY OF THE INVENTION

It is an object of the present invention to solve the above problems separately or all together. Specifically, an object of the present invention is to provide low-cost vacuum exhaust apparatuses that are able to suppress the degradation of lubricity and occurrence of oil film breakage in the pump and that have high reliability and excellent maintainability, even under such circumstances that a large amount of sludge is made and that a large amount of a corrosive gas is repeatedly used over long periods of time, and also provide vacuum exhaust methods using the vacuum exhaust apparatuses.

The inventor conducted elaborate research in order to achieve the above object and accomplished the present invention as a result.

An aspect of the present invention is a vacuum exhaust apparatus comprising: an oil-sealed rotary pump; and an oil supply section for supplying oil to an inlet path of the oil-sealed rotary pump.

The vacuum exhaust apparatus preferably further comprises at least one vacuum pump at a pre-stage before the oil-sealed rotary pump.

The oil supply section may supply oil extracted from the oil-sealed rotary pump.

The oil supply section preferably comprises an oil filtration section.

Preferably, the oil filtration section filtrates the oil extracted from the oil-sealed rotary pump and the oil thus filtrated is supplied to the oil supply section.

Another aspect of the present invention is a vacuum exhaust method using the foregoing vacuum exhaust apparatus, wherein while oil is supplied to the inlet path of the oil-sealed rotary pump to be supplied into a cylinder of the rotary pump, the oil-sealed rotary pump is operated to effect evacuation.

Still another aspect of the present invention is a vacuum exhaust method using the foregoing vacuum exhaust apparatus, wherein while oil extracted from the oil-sealed rotary pump and filtrated is supplied to the inlet path of the oil-sealed rotary pump to be supplied into a cylinder of the rotary pump, the oil-sealed rotary pump is operated to effect evacuation. Preferably, an interior of a vacuum chamber is evacuated while an etching gas to etch a deposited matter away from the interior of the vacuum chamber is supplied into the vacuum chamber.

Preferably, prior to the supply of the etching gas, a deposited film is formed on a substrate in the vacuum chamber and the substrate is taken out thereof.

The present invention provides the low-cost vacuum exhaust apparatuses with excellent maintainability and high reliability, suitable for mass production, and the vacuum exhaust methods using the vacuum exhaust apparatuses.

In the vacuum exhaust apparatuses of the present invention having the above structures, the oil is supplied to the inlet path of the oil-sealed rotary pump. The oil thus supplied is circulated together with the exhaust gas from the vacuum chamber via the inlet port of the rotary pump to be effectively supplied to the junction between the inlet port and the cylinder. The oil is deteriorated most easily at the junction between the inlet port and the cylinder of the rotary pump, but new oil is effectively supplied to this junction, which achieves the effects of improvement in lubricity and prevention of oil film breakage at the portions of contact at mechanical angles between the cylinder and vanes.

Further, since the oil supplied to the junction between the cylinder and the inlet port is drawn into the cylinder, the oil circulating in a small amount is stably circulated inside the rotary pump. This presents the effect of maintaining the amount of oil in the cylinder even in repeated production using volumes of gas over long periods of time and thus effectively maintaining the lubrication and sealing.

As a result, a solution is given to the problems of the failure of seizure or the like and the degradation of evacuation performance and the like due to the film breakage, deterioration of lubricity of oil, and so on. Namely, the reliability and maintainability of the apparatus is enhanced. It also becomes feasible to carry out deposited film formation or etching stably over long periods of time. It is also possible to decrease the production cost. Since the inexpensive rotary pump is used, the instrument cost can be low.

The features of the present invention will be described below in detail by the specification and drawings.

DETAILED DESCRIPTION OF THE PREFERRED EMBODIMENTS

A preferred embodiment of the present invention will be described with reference to the drawings.

Figure 1:
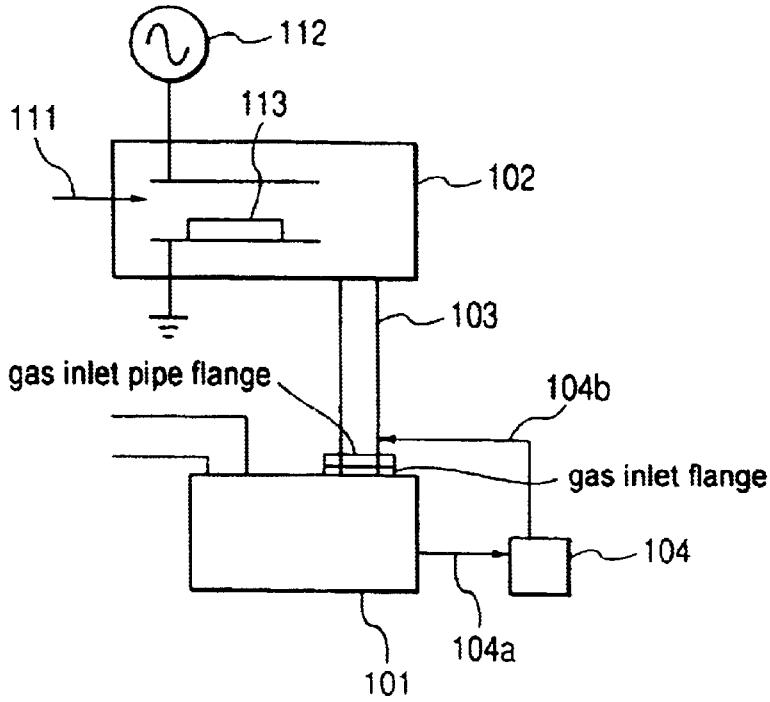
FIG. 1 is a block diagram showing an embodiment of the vacuum exhaust apparatus of the present invention.

FIG. 1 is a schematic block diagram showing a vacuum exhaust apparatus according to the present invention. Numeral 101 designates an oil-sealed rotary pump. The rotary pump 101 is connected to a vacuum chamber (102) by an inlet pipe (103). A constant flow pump (104) is connected to the rotary pump (101) through a pipe (extraction pipe) **(104*a*) for extracting the oil from the interior of the rotary pump. An oil supply pipe (104*b*) is connected from the constant flow pump to the inlet pipe (103). The connection portion between the oil supply pipe (104*b*) and the inlet pipe (103) is located about 5 cm apart on the inlet pipe side from the joint plane between an inlet port flange of the rotary pump (101)** and a flange of the inlet pipe.

Numeral 111 denotes a gas introducing pipe, 112 a high-frequency power supply, and 113 a substrate.

Figure 3:
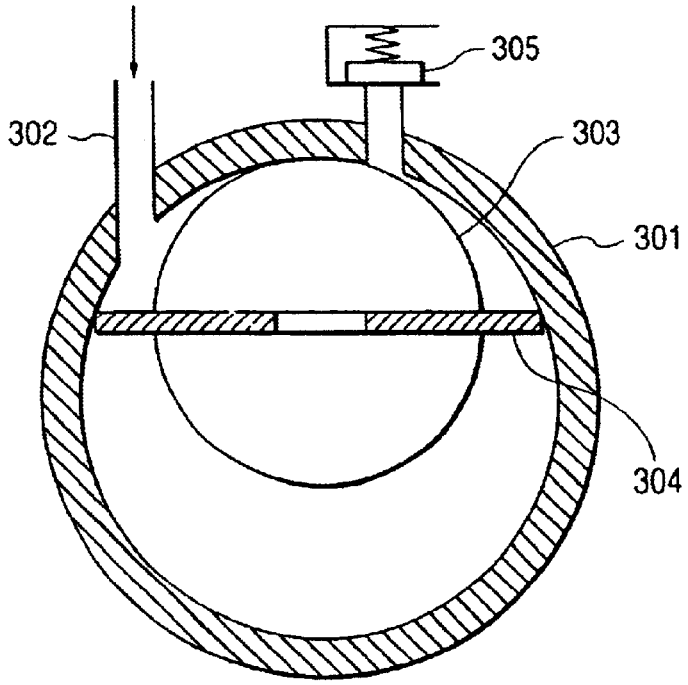
FIG. 3 is a view showing the structure of a cylinder part of the oil-sealed rotary pump.

FIG. 3 is a view showing the structure of the cylinder part of the rotary pump 101.

There are a cylinder (301), and an eccentric rotor (303) with respect to the cylinder 301. A small clearance is maintained between the internal surface of the cylinder 301 and the external surface of the rotor 303. The rotor (303) is provided with two vanes (304), and the vanes (304) slide on the internal wall of the cylinder (301) under the centrifugal force and a force of a spring (not shown) located between the vanes (304), during rotation of the rotor (303). Gas is drawn into the cylinder through an inlet port (302) with counter-clockwise rotation of the rotor (303) and the gas is discharged therefrom through an exhaust valve (305) with further rotation of the rotor, thereby effecting evacuation. The pump is constructed in such structure that a small amount of oil is supplied during the rotation in order to secure the sealing between the vanes and the internal surface of the cylinder and the lubrication at the sliding portions.

The following will describe procedures for deposited film formation using the above vacuum exhaust apparatus and for cleaning of the interior of the chamber by etching.

The rotary pump (101) is started up to evacuate the interior of the chamber (102). A source gas as regulated at a desired flow rate is introduced through the gas introducing pipe (111) into the chamber (102). The high-frequency power supply (112) supplies a high-frequency power to induce a plasma, thereby forming a deposited film on the substrate (113) placed in the chamber. After a desired time, deposited film is obtained, the high-frequency power and source gas are stopped, the gas is purged from the interior of the chamber (102), and thereafter the rotary pump (101) is stopped. Then, the interior of the chamber (102) is brought to the atmospheric pressure and the substrate (113) is taken out thereof.

Then, the rotary pump (101) is again actuated to evacuate the interior of the chamber (102). The constant flow pump (104) is actuated to supply the oil extracted thereby from the rotary pump (101) to the inlet pipe (103) near the inlet port of the rotary pump (101).

An etching gas as regulated at a desired flow rate is introduced through the gas introducing pipe (111) into the chamber (102). The high-frequency power supply (112) supplies the high-frequency power to induce a plasma to etch a film deposited over the interior of the chamber (102), thereby cleaning the interior of the chamber. After the film deposited over the interior of the chamber is removed well, the high-frequency power and etching gas are stopped, the gas is purged from the interior of the chamber (102), and thereafter the constant flow pump (104) and rotary pump (101) are stopped. The interior of the chamber (102) is then brought to the atmospheric pressure.

The formation of a deposited film and the cleaning for the interior of the chamber can be performed according to the above procedures.

Figure 4:
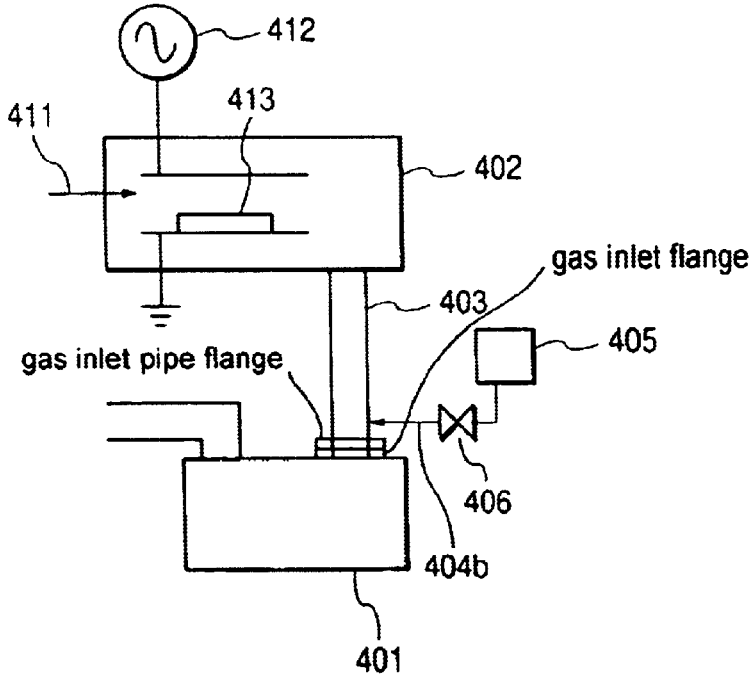
FIG. 4 is a block diagram showing another embodiment of the vacuum exhaust apparatus of the present invention.

In the present invention, there are no specific restrictions on the oil supplied to the inlet path of the rotary pump (an exhaust path for the chamber 102) as long as it is oil for the oil-sealed rotary pump. From the viewpoint of cost, it is preferable to extract the oil from the interior of the rotary pump and circulate it by the constant flow pump or the like. The reason is that there is no need for additionally supplying new oil or that an amount of additional supply thereof can be decreased. It is also possible to employ such a configuration that new oil is supplied from an external oil tank 405 by the constant flow pump, as shown in FIG. 4. It is also possible to combine these configurations.

In FIG. 4, numeral 401 designates an oil-sealed rotary pump, 402 a vacuum chamber, 403 an inlet pipe, 404*b* an oil supply pipe, 411 a gas introducing pipe, 412 a high-frequency power supply, 413 a substrate, 405 an oil tank, and 406 a valve.

The position of supplying (or feeding) oil is preferably located in a region near the inlet port of the rotary pump and in the inlet path of the rotary pump and is preferably a position 15 cm or less apart on the inlet pipe side from the joint plane between the inlet port flange of the rotary pump and the flange of the inlet pipe in order to effectively supply the oil to the junction between the inlet port and the cylinder. This configuration can decrease deterioration of the oil due to the corrosive gas.

Figure 5:
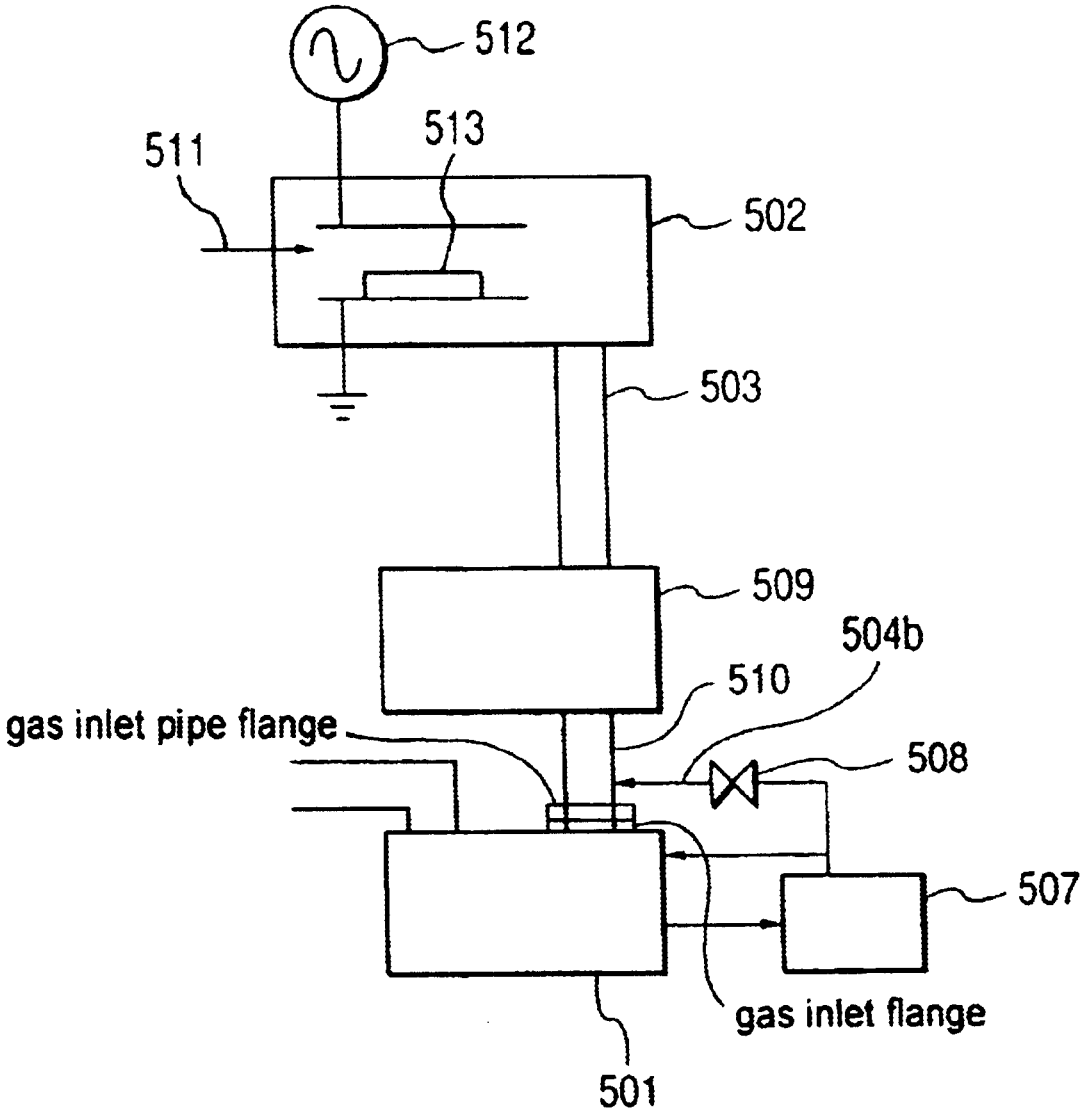
FIG. 5 is a block diagram showing still another embodiment of the vacuum exhaust apparatus of the present invention.

The oil may also be supplied under provision of an oil filtration unit equipped with a constant flow pump. In this case, as shown in FIG. 5, it is preferable to branch an exhaust line (exhaust path) of the oil filtration unit 507 into two lines, connect one line (path) 504*b* to the inlet pipe 510, and connect the other line to the rotary pump 501. In this case, since an exhaust pressure of the oil filtration unit can be utilized for oil feed, there becomes no need for provision of a separate, appendant device such as a constant flow pump or the like, which can decrease the cost and which raises no problem as to failure of the appendant device, thus enhancing the reliability.

In FIG. 5, numeral 501 designates an oil-sealed rotary pump, 502 a vacuum chamber, 503 and 510 inlet pipes, 504*b* an oil supply pipe, 511 a gas introducing pipe, 512 a high-frequency power supply, 513 a substrate, 508 a valve, 507 an oil filtration unit, and 509 a roots pump.

Since the oil filtration unit supplies clean oil without contaminants such as sludge or the like, the lubrication and sealing is maintained in good order inside the cylinder to improve stability of evacuation performance and durability considerably. Since the contaminants of sludge and others are always removed during operation of the rotary pump, it is also possible to clean the entire amount of oil in the rotary pump before the next etching step. Therefore, the oil filtration unit does not have to be one with large capacity, but can be one with capacity normally used, while assuring satisfactory effect. The configuration with the oil filtration unit as described above is particularly preferable, because it presents the further superior effect.

The configuration at the oil supply position can be one of simply connecting the oil supply pipe to the pipe, a port, or the like of the inlet path (inlet pipe), while assuring satisfactory effect, but a more effective configuration is such that there is provided a nozzle having a projecting shape toward the center in the inlet path, or a nozzle capable of spraying the oil in a shower form.

There are no specific restrictions on the amount of oil to be supplied as long as it is within a range where the rotation of the rotary pump is maintained in good order. Since too large amounts of oil can cause backward diffusion due to vapor pressure of the oil, the oil is preferably supplied at about 1 to 50 ml/min in balance with lubricity.

The vacuum exhaust apparatus of the present invention may be provided with a plurality of pumps, for example, by placing at least one pump other than the rotary pump at a pre-stage before the rotary pump (by inserting the other pump(s) in the inlet path). It becomes feasible to increase the degree of vacuum, for example, by combination with a roots pump. The position of supplying oil in this case is preferably determined so as to supply the oil to the pipe that connects the roots pump to the rotary pump.

Since a higher vacuum is required during the deposited film formation or during evacuation from the atmospheric pressure, it is preferable to stop the supply of oil, but there will arise no specific problem without stop of the oil supply.

The present invention will be described in more detail below with examples and comparative examples.

EXAMPLE 1

An amorphous silicon solar cell of the nip layer structure was produced using the vacuum exhaust apparatus provided with the chamber for deposited film formation, shown in FIG. 1. Each of the layers was made by supplying monosilane ($SiH_4$) at 250 ml/min, hydrogen ($H_2$) at 3000 ml/min, phosphine ($PH_3$) at 20 ml/min, and the high-frequency power of 200 W during formation of the n-layer; by supplying monosilane at 100 ml/min, hydrogen at 1000 ml/min, and the high-frequency power of 250 W during formation of the i-layer; and by supplying monosilane at 50 ml/min, hydrogen at 4000 ml/min, boron trifluoride ($BF_3$) at 2 ml/min, and the high-frequency power of 2000 W during formation of the p-layer.

During the cleaning of the interior of the chamber, etching was effected to clean the interior of the chamber under supply of carbon tetrafluoride ($CF_4$) at 1600 ml/min, oxygen ($O_2$) at 400 ml/min, and the high-frequency power of 500 W while the oil was supplied at the rate of 5 ml/min into the inlet pipe.

The deposition of an amorphous silicon film on a stainless steel substrate and the cleaning of the interior of the chamber were repeatedly carried out under the above conditions and according to the procedures described in the embodiment. This operation was continuously carried on as described, and the rotary pump made some noise during cleaning of the seventy second batch. After completion of the eightieth batch, the rotary pump was disassembled and checked, and slight contamination of oil was observed, such as powdery products or sludge, change of viscosity of oil, or the like. However, there was no significant abnormality inside the cylinder and the vacuum exhaust apparatus was able to be further operated after only exchange of oil.

COMPARATIVE EXAMPLE 1

Figure 2:
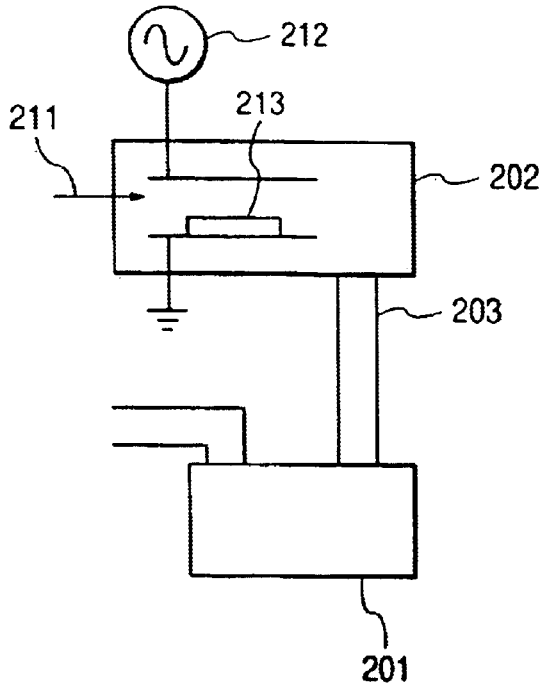
FIG. 2 is a block diagram of a typical vacuum exhaust apparatus.

The apparatus shown in FIG. 2 is a conventional vacuum exhaust apparatus. This apparatus is different from the apparatus of FIG. 1 used in Example 1, in that the oil supply mechanism by the constant flow pump is not provided.

An amorphous silicon solar cell of the nip layer structure was produced using the vacuum exhaust apparatus provided with the chamber for deposited film formation, shown in FIG. 2. Each of the layers was made by supplying monosilane ($SiH_4$) at 250 ml/min, hydrogen ($H_2$) at 3000 ml/min, phosphine ($PH_3$) at 20 ml/min, and the high-frequency power of 200 W during formation of the n-layer; by supplying monosilane at 100 ml/min, hydrogen at 1000 ml/min, and the high-frequency power of 250 W during formation of the i-layer; and by supplying monosilane at 50 ml/min, hydrogen at 4000 ml/min, boron trifluoride ($BF_3$) at 2 ml/min, and the high-frequency power of 2000 W during formation of the p-layer.

During the cleaning of the interior of the chamber, etching was effected to clean the interior of the chamber under supply of carbon tetrafluoride ($CF_4$) at 1600 ml/min, oxygen ($O_2$) at 400 ml/min, and the high-frequency power of 500 W.

The deposition of an amorphous silicon film on the stainless steel substrate and the cleaning of the interior of the chamber were repeatedly carried out under the above conditions and according to the procedures described in the embodiment, except that the oil was not supplied. This operation was continuously carried on in this manner, and the rotary pump made some noise during the cleaning of the twenty third batch. The rotary pump was broken and stopped during the cleaning of the twenty seventh batch. The rotary pump was disassembled and checked, and it was found that the interior of the cylinder was short of oil and that there occurred failure of seizure for the vanes of the rotor to be unable to rotate in the cylinder. There also appeared the sludge and change in the viscosity of oil, and the oil was heavily contaminated. This conceivably resulted from clogging in the rotary pump, which impeded the normal circulation of oil in the cylinder.

EXAMPLE 2

In the apparatus shown in FIG. 4, numeral 405 represents the oil tank which is filled with new oil. This new oil is supplied at a constant flow rate through the oil supply pipe (404*b*) to the inlet pipe (403) near the inlet port of the rotary pump (401) by operation of the valve (406). The connection portion between the oil supply pipe (404*b*) and the inlet pipe (403) is located at the position 5 cm apart on the inlet pipe (403) side from the joint plane between the inlet port flange of the rotary pump (401) and the flange of the inlet pipe (403). The other structure is much the same as in Example 1.

An amorphous silicon solar cell of the nip layer structure was produced using the vacuum exhaust apparatus provided with the chamber for deposited film formation, shown in FIG. 4. Each of the layers was made by supplying monosilane ($SiH_4$) at 250 ml/min, hydrogen ($H_2$) at 3000 ml/min, phosphine ($PH_3$) at 20 ml/min, and the high-frequency power of 200 W during formation of the n-layer; by supplying monosilane at 100 ml/min, hydrogen at 1000 ml/min, and the high-frequency power of 250 W during formation of the i-layer; and by supplying monosilane at 50 ml/min, hydrogen at 4000 ml/min, boron trifluoride ($BF_3$) at 2 ml/min, and the high-frequency power of 2000 W during formation of the p-layer.

During the cleaning of the interior of the chamber, etching was effected to clean the interior of the chamber under supply of carbon tetrafluoride ($CF_4$) at 1600 ml/min, oxygen ($O_2$) at 400 ml/min, and the high-frequency power of 500 W while the oil was supplied at the oil supply rate of 5 ml/min by the valve (406).

The deposition of an amorphous silicon film on the stainless steel substrate and the cleaning of the interior of the chamber were repeatedly carried out under the above conditions and according to the procedures described in the embodiment. The operation was continuously carried on under the constant flow supply of new oil in this way. The oil level of the rotary pump was raised up to the upper limit at the end of the fiftieth batch, and thus the oil was discharged from the pump to near the lower limit of the oil level. The operation was continuously carried further on, and the rotary pump made some noise during cleaning of the ninety second batch. After completion of the hundredth batch, the rotary pump was disassembled and checked, and slight contamination of the oil was observed, such as the powdery products, sludge, change of the viscosity of oil, or the like. However, there was no significant abnormality inside the cylinder, and the pump was able to be continuously operated after only exchange of oil.

EXAMPLE 3

In the apparatus shown in FIG. 5, numeral 507 designates the oil filtration unit, which has the structure of drawing the oil in the rotary pump (501) therefrom, removing the contaminants such as the powdery products, sludge, etc. by the filter, and thereafter discharging the oil into the rotary pump (501). One line branching off from the exhaust line of the oil filtration unit (507) is routed as the oil supply pipe (504*b*) via the valve (508) to the inlet pipe (510) connecting the rotary pump (501) to the roots pump (509). The connection portion between the oil supply pipe (504*b*) and the inlet pipe (510) is located at the position 5 cm apart on the inlet pipe (510) side from the joint plane between the inlet port flange of the rotary pump (501) and the flange of the inlet pipe (510). The other structure is much the same as in Example 1. In this structure, a part of the oil as discharged from the oil filtration unit (507) is supplied at the constant flow rate to the inlet pipe (510) by operation of the valve (508). The other line branching off from the exhaust line is connected to the rotary pump so as to be able to circulate the extracted oil. For this reason, by making the oil filtration unit (507) always in operation, even during a stop of the rotary pump (501), the oil can be always cleaned. Further, the provision of the roots pump can enhance the degree of vacuum further.

An amorphous silicon solar cell of the nip layer structure was produced using the vacuum exhaust apparatus provided with the chamber for deposited film formation, shown in FIG. 5. Each of the layers was made by supplying monosilane ($SiH_4$) at 250 ml/min, hydrogen ($H_2$) at 3000 ml/min, phosphine ($PH_3$) at 20 ml/min, and the high-frequency power of 200 W during formation of the n-layer; by supplying monosilane at 100 ml/min, hydrogen at 1000 ml/min, and the high-frequency power of 250 W during formation of the i-layer; and by supplying monosilane at 50 ml/min, hydrogen at 4000 ml/min, boron trifluoride ($BF_3$) at 2 ml/min, and the high-frequency power of 2000 W during formation of the p-layer.

During the cleaning of the interior of the chamber, etching was effected to clean the interior of the chamber under supply of carbon tetrafluoride ($CF_4$) at 1600 ml/min, oxygen ($O_2$) at 400 ml/min, and the high-frequency power of 500 W while the oil supply rate of 10 ml/min by the valve (508).

The deposition of an amorphous silicon film on the stainless steel substrate and the cleaning of the interior of the chamber were repeatedly carried out under the above conditions and according to the procedures described in the embodiment. The operation was continuously carried on in this manner, and there appeared no abnormality of noise or the like in the rotary pump even at the end of the hundredth batch. When the rotary pump was disassembled and observed, there was no abnormality inside the cylinder, and contamination of the pump oil was slight. When the operation was further carried on, there occurred no problem at the two hundredth batch.

The vacuum exhaust apparatuses of the present invention made it feasible to maintain the lubrication and sealing inside the cylinder of the rotary pump by the simple and inexpensive apparatus structure and the easy operation methods even under such circumstances that a large amount of sludge is generated and that a large amount of corrosive gas is repetitively used over long periods of time, for mass production. This made it feasible to provide the low-cost vacuum exhaust apparatuses and vacuum exhaust methods with high reliability and excellent maintainability suitable for mass production, without causing the problems of the degradation of evacuation performance, the oil film breakage, and so on.

What is claimed is:

1. A vacuum exhaust apparatus comprising:

an oil-sealed rotary pump having a gas inlet for taking a gas into the pump, the gas inlet having a gas inlet flange to join with a flange of a gas inlet pipe for guiding the gas to said pump; and an oil supply section for connecting with the gas inlet pipe and supplying an oil into the gas inlet pipe, wherein said oil supply section is constructed to supply the oil into the gas inlet pipe at a location which is 15 cm or less apart from a joint plane between said gas inlet flange of said rotary pump and the flange of the gas inlet pipe.

2. The vacuum exhaust apparatus according to claim 1, further comprising at least one vacuum pump at a pre-stage before said oil-sealed rotary pump.

3. The vacuum exhaust apparatus according to claim 1, wherein said oil supply section supplies oil extracted from said oil-sealed rotary pump.

4. The vacuum exhaust apparatus according to claim 1, wherein said oil supply section comprises an oil filtration section.

5. The vacuum exhaust apparatus according to claim 4, wherein said oil filtration section filtrates oil extracted from said oil-sealed rotary pump and supplies the filtrated oil to said oil supply section.

6. The vacuum exhaust apparatus according to claim 1, wherein the supplied oil is a new oil.

7. A vacuum exhaust method comprising the steps of:

providing an oil-sealed rotary pump having a gas inlet for taking a gas into the pump, the gas inlet having a gas inlet flange to join with a flange of a gas inlet pipe for guiding the gas to the pump, and an oil supply section for connecting with the gas inlet pipe and supplying an oil into the gas inlet pipe;

constructing the oil supply section to supply the oil into the gas inlet pipe at a location which is 15 cm or less apart from a joint plane between the gas inlet flange of the rotary pump and the flange of the gas inlet pipe; and while supplying the oil to the inlet path of the oil-sealed rotary pump to be supplied into a cylinder of the rotary pump, operating the oil-sealed rotary pump to effect evacuation.

8. The vacuum exhaust method according to claim 7, wherein while an etching gas to etch a deposited matter away from an interior of a vacuum chamber is supplied into the vacuum chamber, the interior of the vacuum chamber is evacuated.

9. The vacuum exhaust method according to claim 8, wherein, prior to the supply of the etching gas, a deposited film is formed on a substrate in the vacuum chamber and the substrate is taken out.

10. A vacuum exhaust method comprising the steps of:

providing an oil-sealed rotary pump having a gas inlet for taking a gas into the pump, the gas inlet having a gas inlet flange to join with a flange of a gas inlet pipe for guiding the gas to the pump, and an oil supply section for connecting with the gas inlet pipe and supplying an oil into the gas inlet pipe, wherein the oil supply section comprises an oil filtration section;

constructing the oil supply section to supply the oil into the gas inlet pipe at a location which is 15 cm or less apart from a joint plane between the gas inlet flange of the rotary pump and the flange of the gas inlet pipe; and while supplying oil as extracted from the oil-sealed rotary pump and filtrated to the inlet path of the oil-sealed rotary pump to be supplied into a cylinder of the rotary pump, operating the oil-sealed rotary pump to effect evacuation.

11. The vacuum exhaust method according to claim 10, wherein while an etching gas to etch a deposited matter away from an interior of a vacuum chamber is supplied into the vacuum chamber, the interior of the vacuum chamber is evacuated.

12. The vacuum exhaust method according to claim 11, wherein, prior to the supply of the etching gas, a deposited film is formed on a substrate in the vacuum chamber and the substrate is taken out.

13. A vacuum exhaust apparatus comprising:

an oil-sealed rotary pump having a gas inlet for taking a gas into the pump, the gas inlet having a gas inlet flange to join with a flange of a gas inlet pipe for guiding the gas to said pump; and an oil supply section for supplying an oil to a gas inlet path for guiding a gas into said oil-sealed rotary pump, wherein said oil supply section is constructed to supply the oil at 1–50 ml/min, and said oil supply section is constructed to supply the oil into the gas inlet pipe at a location which is 15 cm or less apart from a joint plane between said gas inlet flange of said rotary pump and the flange of the gas inlet pipe.

14. The vacuum exhaust apparatus according to claim 13, wherein said oil supply section is constructed to supply a part of the oil extracted from said oil-sealed rotary pump to the gas inlet path at 1–50 ml/min and supply the rest of the extracted oil to said oil-sealed rotary pump.

15. The vacuum exhaust apparatus according to claim 14, wherein said oil supply section comprises an oil filtration section for filtrating the oil extracted from said oil-sealed rotary pump and feeding the oil thus filtrated to said oil supply section.

* * * * *

UNITED STATES PATENT AND TRADEMARK OFFICE

CERTIFICATE OF CORRECTION

PATENT NO. : 6,699,022 B2
DATED : March 2, 2004
INVENTOR(S) : Hiroshi Izawa

It is certified that error appears in the above-identified patent and that said Letters Patent is hereby corrected as shown below:

Title page,
Item [56], References Cited, FOREIGN PATENT DOCUMENTS,

| | | | |
|---|---|---|---|
| "JP | 60219493 A * | 11/1985 | .....F04C/29/02 |
| JP | 62291488 A * | 12/1987 | .....F04C/25/02 |
| JP | 2-21914 | 1/1990 | |
| JP | 02129371 A * | 5/1990 | ..... C23C/16/44 |
| JP | 02129372 A * | 5/1990 | ..... C23C/16/44 |
| JP | 06074174 A * | 3/1994 | ..... F04C/23/00" |

should read

| | | | |
|---|---|---|---|
| -- JP | 60-219493 A * | 11/1985 | .....F04C/29/02 |
| JP | 62-291488 A * | 12/1987 | .....F04C/25/02 |
| JP | 2-21914 | 1/1990 | |
| JP | 2-129371 A * | 5/1990 | ..... C23C/16/44 |
| JP | 2-129372 A * | 5/1990 | ..... C23C/16/44 |
| JP | 6-074174 A * | 3/1994 | ..... F04C/23/00 -- |

Signed and Sealed this

Thirty-first Day of August, 2004

JON W. DUDAS
*Director of the United States Patent and Trademark Office*